United States Patent [19]

Kostiner

[11] 4,268,156

[45] May 19, 1981

[54] WASHING APPARATUS FOR PHOTOGRAPHIC MATERIALS

[76] Inventor: Edward Kostiner, 218 Oakridge Dr.,, Baie D'Urfe, Quebec, H9X 2N4, Canada

[21] Appl. No.: 54,623

[22] Filed: Jul. 3, 1979

[51] Int. Cl.[3] ..... G03D 3/04

[52] U.S. Cl. ..... 354/324; 354/328; 354/331; 134/102; 366/166

[58] Field of Search ..... 354/324, 326, 328, 329, 354/330, 331, 337, 338; 134/94, 100, 102; 366/101, 150, 166, 167; 239/428.5; 68/183

[56] References Cited

U.S. PATENT DOCUMENTS

| | | | |
|---|---|---|---|
| 1,526,179 | 2/1925 | Parr et al. | 68/183 |
| 2,892,394 | 6/1959 | Hixon et al. | 354/328 |
| 3,077,155 | 2/1963 | Maddock et al. | 354/328 |
| 3,180,243 | 4/1965 | Siskind et al. | 134/94 |
| 3,259,049 | 7/1966 | Uithoven | 354/328 |
| 3,657,990 | 10/1960 | Wilhelm | 134/102 |
| 3,744,395 | 7/1973 | Berchtold | 354/328 |
| 3,816,844 | 6/1974 | Pfefer | 354/328 |
| 4,001,855 | 1/1977 | Wilhelm | 354/324 |

*Primary Examiner*—L. T. Hix

*Assistant Examiner*—Alan Mathews

*Attorney, Agent, or Firm*—Larson, Taylor and Hinds

[57] ABSTRACT

A washing apparatus for washing photographic materials is disclosed. The apparatus has an aerator which can be adjusted to supply air and water at varying flow and water pressures and overcomes other problems in print and negative washers of this type. The apparatus comprises a tank for holding photographic materials such as prints and negatives, a plurality of fluid entrance holes at the bottom of the tank and a fluid distribution system connecting the plurality of fluid entrance holes to an inlet outside and adjacent the bottom of the tank. A removable aerator means is provided, adapted to fit into the inlet of the fluid distribution system, the aerator means has a connection to a water supply and a water jet within a tubular housing which has an inside cross sectional area that may be changed to vary the flow of water through the jet. A collar is provided having a first orifice therein mounted for rotation about the tubular housing which has a second orifice therein which upon rotation of the collar matches with the first orifice to permit air to enter the tubular housing and hence the fluid distribution system to mix with water from the water jet.

6 Claims, 11 Drawing Figures

WASHING APPARATUS FOR PHOTOGRAPHIC MATERIALS

The present invention relates to fluid washing devices, more specifically the present invention relates to a tank and attachments that may be used in washing photographic prints, negatives, plates and the like.

In the preparation of photographic prints and negatives there is a need to wash off the chemicals used in the printing and developing steps. This is done generally by immersing the print or negative in water and agitating the water to ensure that all the chemicals are washed off. Print washers are available on the market today. One such washer is shown in U.S. Pat. No. 3,657,990 to Wilhelm wherein a rectangular tank is provided with a series of individual compartments in which prints may be placed for washing. A combination of air and water are bubbled through the compartments from underneath the tank, and an overflow is provided at the top to ensure water is continuously changed. An aerator is provided with a special snorkel tube to such in air from above the water level in the tank. One problem that exists with this tank is that the water cannot easily be drained and consequently the tank is generally left full. This sometimes results in algae growing in the tank which effects the washing of prints. Furthermore, the air inlet to the aerator is a fixed size, therefore, whereas the system may work adequately at one water pressure it cannot take into account variations in water pressure and water flow. Thus under some conditions, particularly low water pressures, air is not drawn into the aerator. This can cause prints to stick to ribs provided in the side of the compartments, which results in marks remaining on the prints. Another problem that exists with the Wilhelm apparatus is that there is no adequate protection to prevent two prints in one compartment from overlapping. Although Wilhelm does show print hold downs in FIGS. 10A and 11, these have not been found to be satisfactory inasmuch as prints can become wedged between the hold down bar and the vertical dividing plate, and two prints in one chamber tend to move together and overlap causing insufficient washing.

Wilhelm also shows the plates forming the compartments extending up above the water drain and thus the top of the plates are never washed. Chemicals sometimes remain on these plates which sometimes are transferred to prints on removal from the washer, thus contaminating the prints.

One further problem that exists with the Wilhelm apparatus is that the flow of water and air into the individual chambers is not evenly distributed inasmuch as there is no fluid distribution system to spread the fluid flow evenly to all the individual compartments. Thus some parts of the tank tend to receive higher flows than other parts.

Another type of film washing apparatus is shown by Pfefer in U.S. Pat. No. 3,816,844. This apparatus has a cylindrical wall and is used for washing negatives. As in the Wilhelm patent, snorkel tubes are provided for the aerators and there is no easy way to drain the water out of the tank. Pfefer shows two aerators designed to produce a swirl effect inside the cylindrical tank. Neither of the aerators have a variable air supply, thus under low water pressure air cannot be drawn into the aerator. Furthermore, both Pfefer and Wilhelm show an apparatus wherein the aerator is integral with the tank.

The present invention provides a washing apparatus wherein there is a removable aerator having a connection to a water supply and a variable air inlet means to limit the quantity of air entering the aerator. Furthermore the size of jet in the aerator may be changed to vary water flow through the jet. Thus by varying the size of the air inlet and the size of the jet, the aerator operates at almost all variations of water pressure and water flow. This allows for proper aeration in each compartment and avoids any need of having ribs on the sides of the compartment so the problem of prints sticking to ribs does not occur. Furthermore, with a removable aerator one is able to use the same aerator in either a negative washer or a print washer either by using it as a bubbler from underneath or in certain cases by using it as a top feed washer.

With the aerator being easily removable, it is a simple matter to remove it from the inlet at the base of the tank so that the tank drains. Alternatively, by simple turning off the water supply, the tank slowly drains through the air inlet in the aerator. If the tank is not to drain, then it is a simple matter to close the variable air inlet means so that the water remains in the tank.

Most print washers require a reasonably high flow of water into the washer, otherwise the aerator does not function properly and satisfactory washing of the print does not occur. The present invention provides an aerator in which the jet may be replaced by one of smaller diameter so that less flow of water than existing washers is needed to aerate the tank and provide a satisfactory washing action. Furthermore, the present system provides a fluid distribution system so that an equal amount of the aerated water is distributed to all the fluid entrance holes.

A normal household water pressure is around 50 psi, however, even at one water outlet this pressure can vary considerably depending on the use of water in surrounding locations. It has been found that if a $\frac{1}{8}$ inch diameter jet is used in the aerator a flow through the unit is between $1\frac{1}{2}$ to 2 gallons/minute. If the jet is reduced to 1/16 inch diameter, the flow drops to 4/5 to $1\frac{1}{4}$ gallons/minute. By varying the air supply to the aerator, it has been found sufficient air is drawn into the aerator to aerate the tank and prevent prints sticking to the sides of the compartments.

In the case of a print washer, a cover plate is provided to prevent the prints overlapping each other in the separate compartments and prevent them becoming wedged as in the old type of print hold down bar. The height of the partitions between the compartments is at the same level as the water overflow so the top surface of the partitions is always washed, thus avoiding the problem of contamination of the prints. Furthermore, by having the aerator as a separate unit the print washer may be adapted to have the cover plate removed and replaced by a box sitting on top of the washer, feeding water through a series of holes into the separate compartments of the print washer and then allowing the water to drain from the base of the tank, in this way providing a top feed print washer.

The present invention provides a washing apparatus for washing photographic materials comprising, a tank for holding photographic materials, a plurality of fluid entrance holes at the bottom of the tank, a fluid distribution system connecting the plurality of fluid entrance holes to an inlet outside and adjacent to the bottom of the tank, a removable aerator means adapted to fit into the inlet of the fluid distribution system, the aerator means having a connection to a water supply, the aerator means having a water jet within a tubular housing the water jet having an inside cross sectional area which may be changed to vary the flow of water through the jet, and a collar having a first orifice therein mounted for rotation about the tubular housing, the tubular housing having a second orifice therein which upon rotation of the collar matches with the first orifice to permit air to enter the tubular housing and hence the fluid distribution system to mix with water from the water jet.

In the case when the tank is used as a negative washer it is cylindrical in shape and has a plurality of fluid entrance holes extending outwardly horizontally from a ring at the center of the bottom of the tank and has an inverted frusto-conical form located on top of the ring.

In another embodiment when the tank is used as a print washer it is generally rectangular in shape and has a rectangular bottom and rectangular sides. One side of the tank has a lower height than the other three sides to form a weir for water overflow and a plurality of parallel spaced apart partitions extend across the tank from the bottom to the height of the one side and a cover having a plurality of large holes therein extending over all the partitions and the one side, adapted to keep prints being washed below the water level.

In drawings which illustrate the embodiments of the invention:

Figure 1:
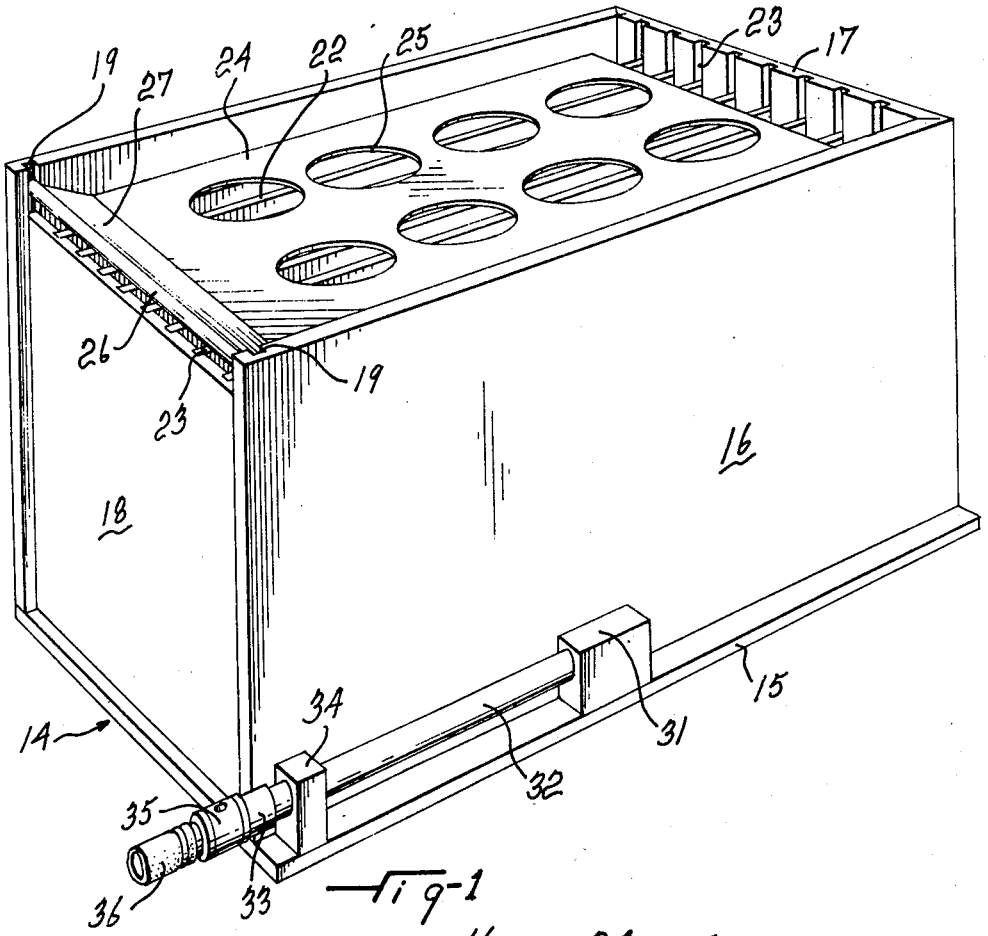
FIG. 1 shows a perspective view of one embodiment of a print washer according to the present invention.
Figure 2:
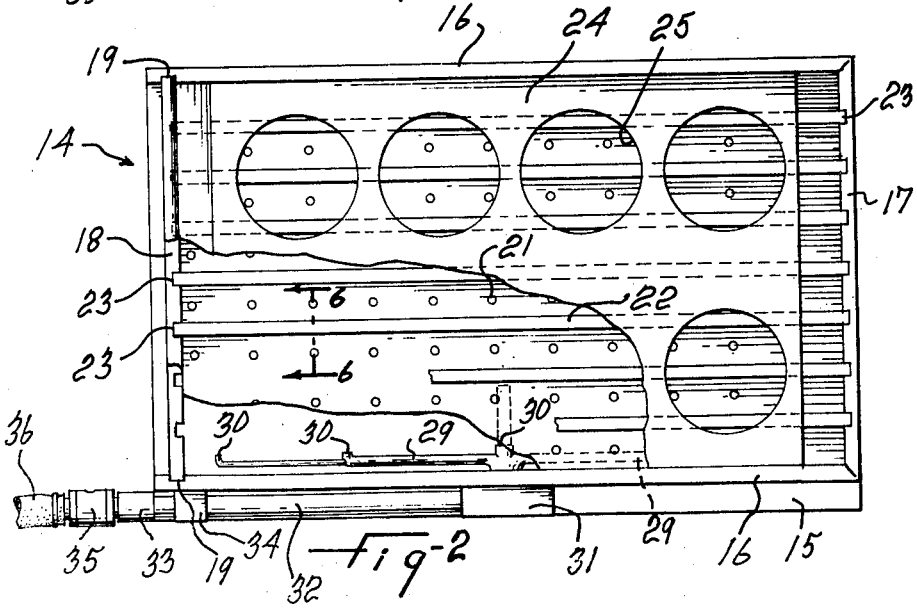
FIG. 2 is a top plan view partially in section, of the print washer shown in FIG. 1.
Figure 3:
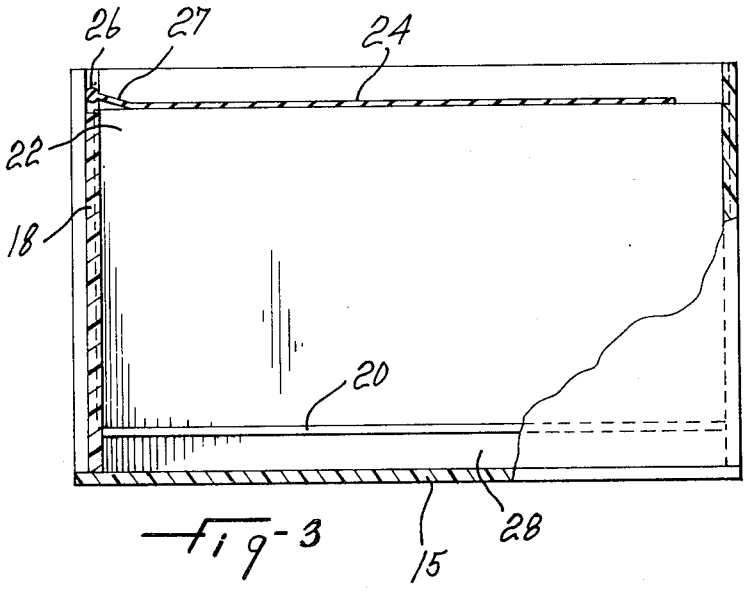
FIG. 3 is a side view, partly in section, of the print washer shown in FIG. 1.

Referring now to the drawings, FIGS. 1, 2 and 3 show a print washing tank 14. The tank 14 has a rectangular base or bottom 15 wiith two large rectangular sides 16 and one end 17 formed from a single sheet of material notched and bent at two corners as may be seen in FIG. 2. In some cases the rectangular sides 16 and end 17 may be made from separate sheets of material. The fourth side forms a weir plate 18 which fits into slots 19 provided in the ends of the two large rectangular sides 16. The weir plate 18 does not extend up as high as the other three sides and presents a weir for the water to flow over and pass to drain from the tank. A perforated plate 20 is positioned above the rectangular base plate 15 so as to constitute a raised floor. This perforated plate 20 has a series of perforations 21 for fluid to enter the tank and is discussed in more detail hereafter. A plurality of partition plates 22 are spaced equally apart vertically across the tank to form compartments. The partition plates 22 fit into parallel grooves 23 provided in the weir plate 18 and the end 17. The vertical partition plates 22 extend from the top of the weir plate 18 down to grooves in the perforated plate 20, thus dividing the tank into compartments. The grooves 23 support the partition plates 22 in place and aid in preventing bowing or bending of the plates.

A cover plate 24 sits on top of the vertical partition plates 22. In the embodiment shown, the cover plate has a series of large holes 25 therein to allow the air in the tank to bubble up and escape through the holes and to ensure that the water level is at least above the bottom surface of the cover plate 24. The cover plate may be made of a mesh screen or any other construction of cover extending over all the partition plates 22 and weir plate 18 and having holes therein to allow water to pass through. At one end, the cover plate 24 has two lugs 26 which extend outwards one from each side and fit into slots 19 in the two rectangular side plates 16. The two lugs 26 allow the cover plate 24 to pivot upwards in the slots 19. A sloped portion 27 adjacent the two lugs 26 of the cover plate 24 raises the end of the cover plate 24 so water is not prevented from flowing over the weir plate 18. The cover plate terminates before the end 17 to provide a space to insert fingers for lifting the cover plate 24. In operation the coverplate 24 may be pivoted upwards about the two lugs 26 or alternatively may be lifted right off the tank by merely sliding the two lugs 26 upwards in the grooves 19. The cover plate 24 holds prints within the compartments and prevents them moving together and overlapping or floating up so that part of the print is above the water level.

Figure 4:
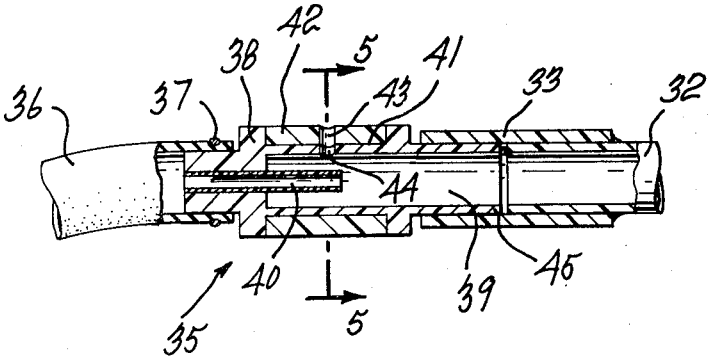
FIG. 4 is a cross sectional side view of an aerator according to the present invention suitable for attachment to a print washer or negative washer.
Figure 5:
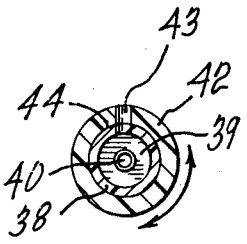
FIG. 5 is a cross sectional view through the aerator taken at line 5—5 of FIG. 4.

A space 28 is provided between the rectangular base or bottom 15 and the perforated plate or raised floor 20 and a fluid distribution system 29 is located therein which permits an even distribution of the fluid entering the tank. The fluid distribution system has a fluid entrance at the mid point of the length of the tank 14 and a manifold system with outlets 30 evenly spaced along the length of the tank 14. The position and size of outlets 30 is arranged to give an even distribution of air and water across the area of the perforated plate 20 so that air bubbles come up through each perforation 21. The manifold system and outlets 30 are designed so that the fluid flow is distributed evenly. An entrance block 31 which is merely an elbow, is positioned outside the tank 14 at the fluid entrance, and connects to a conduit 32 which terminates at its end to a quick connect coupling 33. A clamp 34 holds the conduit 32 in position to the side of the tank. An aerator 35 is shown joined to the quick connect coupling 33. The aerator 35 is joined to a hose 36 which is connected to a standard household water supply. The aerator 35 is shown in detail in FIGS. 4 and 5 wherein the hose 36 has a clamp ring 37 holding it to the end of a shoulder forming part of a tubular housing 38. Inside the shoulder and extending forward into a tubular space 39 within the housing 38 is a jet 40 having a considerably smaller diameter than the tubular space 39. The jet 40 may be a fixed diameter, in which case different aerator units are required with varying jet diameters. Alternatively the jet 40 may be replaceable with different sizes to suit water flow and pressure conditions. In one embodiment an adjustable diaphragm jet may be incorporated in the aerator so the jet size may be changed without replacement. The housing 38 has an external groove section 41 which holds a collar 42 adapted to rotate about the tubular housing 38. The collar 42 has an aperture 43 therein which matches with a second aperture 44 in the internal housing 38. When the two apertures 43 and 44 are matched up, air enters into the tubular space 39 and mixes with the water passing through the jet 40 to provide a mixture of air and water passing to the tank. By rotating the collar 42 so that the collar aperture 43 only partially coincides with the housing aperture 43, the air entering the tubular space 39 is reduced. The air supply may be shut off completely by turning the collar 42 so that the aperture 43 and 44 do not coincide at all. The aerator 35 allows a variation in the air entering the tubular space 39 and thus by varying the size of jet 40 and the air opening, all variations in water pressure and flow are taken into account. Less water is needed for aerating the tank 14 than previous types of print washers. A plug-in socket section 45 at the end of the aerator 35 fits into the quick connect coupling 33 on the side of the tank 14. This coupling system is a simple tapered plug in a tapered socket made from plastic and arranged so that it does not separate unless pulled. Unplugging the socket section 45 allows the tank 14 to drain through the conduit 32. When the collar aperture 43 is left coinciding with the housing aperture 44 and the water supply to the hose 36 is turned off, then the water in the tank drains out slowly through the apertures 43, 44 so that water does not remain in the tank 14. If the apertures 43, 44 do not coincide, then the water does not drain from the tank 14.

Figure 6:
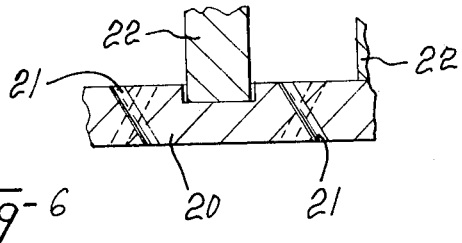
FIG. 6 is a partial cross sectional view taken at line 6—6 of FIG. 2.

FIG. 6 shows a detail of the perforated plate 20 with perforations 21 thereon. The partition 22 fits into a groove in the perforated plate 20. As is seen, the perforations 21 are staggered, one being slanted to one side of the compartment directing the fluid to one partition 22 and the next perforation 21 slanted in the other direction so the fluid is directed at the other partition 22. The perforations 21 are arranged in rows along the perforated plate 20 in each compartment.

Figure 7:
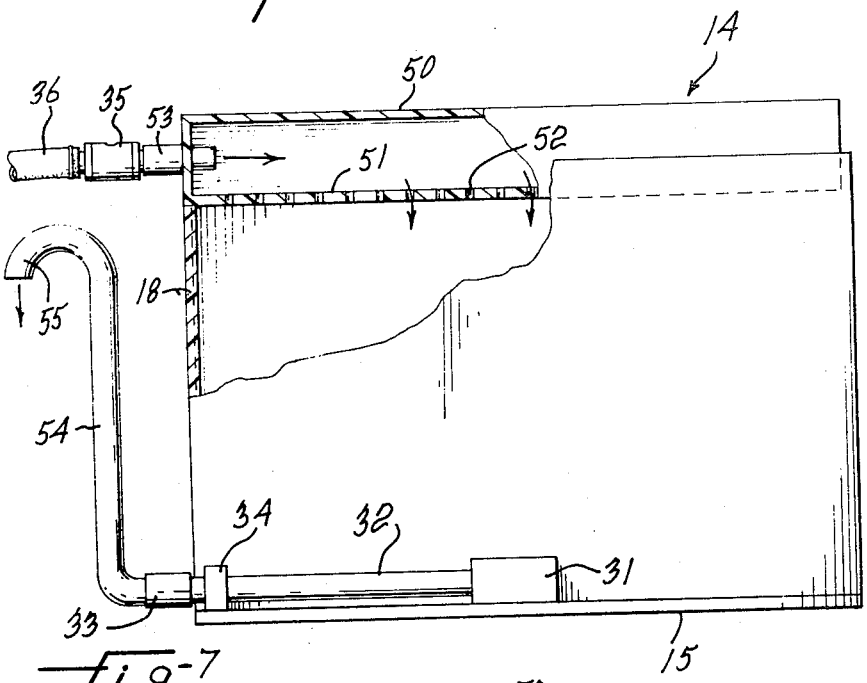
FIG. 7 is a side view, partly in section, of a print washer having a top feed system.
Figure 8:
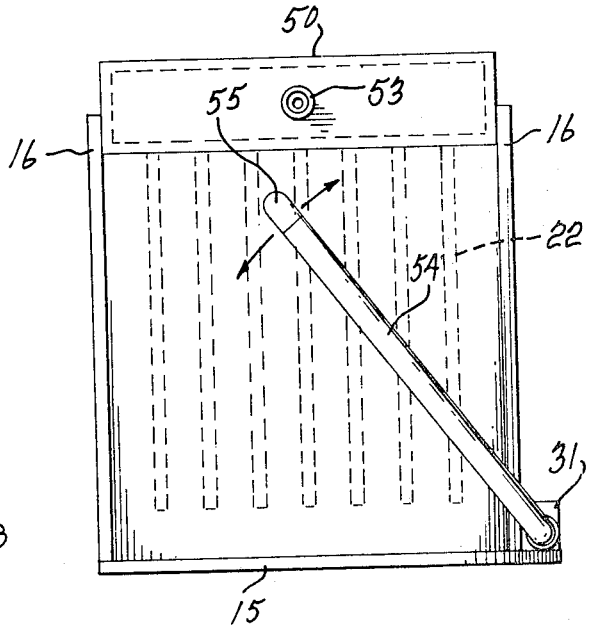
FIG. 8 is an end view of the print washer shown in FIG. 7.

A variation of the rectangular tank shown in FIGS. 1–3 is shown in FIGS. 7–8 wherein the cover plate 24 is removed and a special top feed box 50 rests on the weir plate 18 and partition plates 22, fitting exactly within the sides 16 and end 17. The top feed box 50 is hollow and contains a lower plate 51 with a plurality of perforations 52 therein. The perforations 52 are so arranged that water within the box 50 enters into each of the compartments between the partition plates 22. A quick connector coupling 53 is provided at one end of the box 50 to which the aerator 35 may be attached, thus air and water or if preferred water only flows into the box 50 through the perforations 52 and into the compartments between the partitions 22. As the aerator 35 is removed from the lower portion of the tank 14, the bottom quick connector coupling 33 has a drain tube 54 inserted therein having a U section 55 at its top. The U section 55 is not essential and may be omitted. The drain tube 54 may be pivoted about the quick connector coupling to a desired height to allow the level within the tank to be determined depending upon the pivoted height of the U section 55 of the drain tube 54. If the drain tube 54 is in the vertical position, water will flow over the weir plate 18 in the normal manner. However, when water is flowing out of the drain tube 54 then the water in each compartment is flowing from top to bottom which is the reverse of the tank arrangement shown in FIGS. 1 to 3. The drain tube 54 shown in the drawings is pivoted about the bottom quick connector coupling 33 as shown. In another embodiment a telescoping tube may replace the drain tube 54 shown. Thus there is no need to have the tube pivot, the height of the tube can be set with the telescopic tube.

Figure 9:
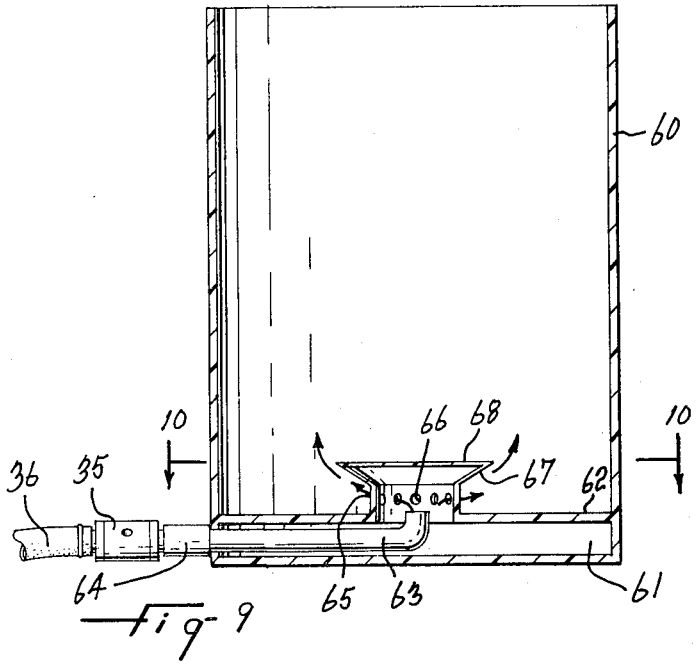
FIG. 9 is a cross sectional side view of one embodiment of a negative washer according to the present invention.
Figure 10:
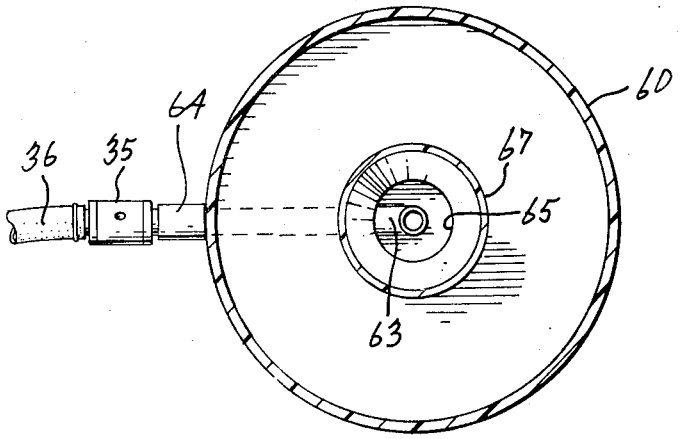
FIG. 10 is a cross sectional view through the negative washer taken at line 10—10 of FIG. 9.

Another embodiment of a washing apparatus is shown in FIGS. 9 and 10 wherein a tank having a cylindrical wall 60 is provided for washing negatives in a roll. A pipe 63 fits beneath the bottom of the tank 62. The pipe 63 terminates at a quick connect coupling 64 outside the tank 60. An aerator 35 is connected to this quick connect coupling 64. A ring 65 is connected to the base 62 of the tank, the ring 65 having a series of perforations 66 extending horizontally around the circumference. The pipe 63 provides fluid to the center of the ring 65 and the fluid flows through the perforations 66 into the tank 60. Above the ring 65 is an inverted frusto-conical form 67 with a flat top 68. A negative is placed into the tank in a rack which holds it in a roll form, air and water enter through the perforations 66 in the ring 65, pass around the frusto-conical form 67 and up to the surface of the tank. The water overflows the tank and falls on all sides.

Figure 11:
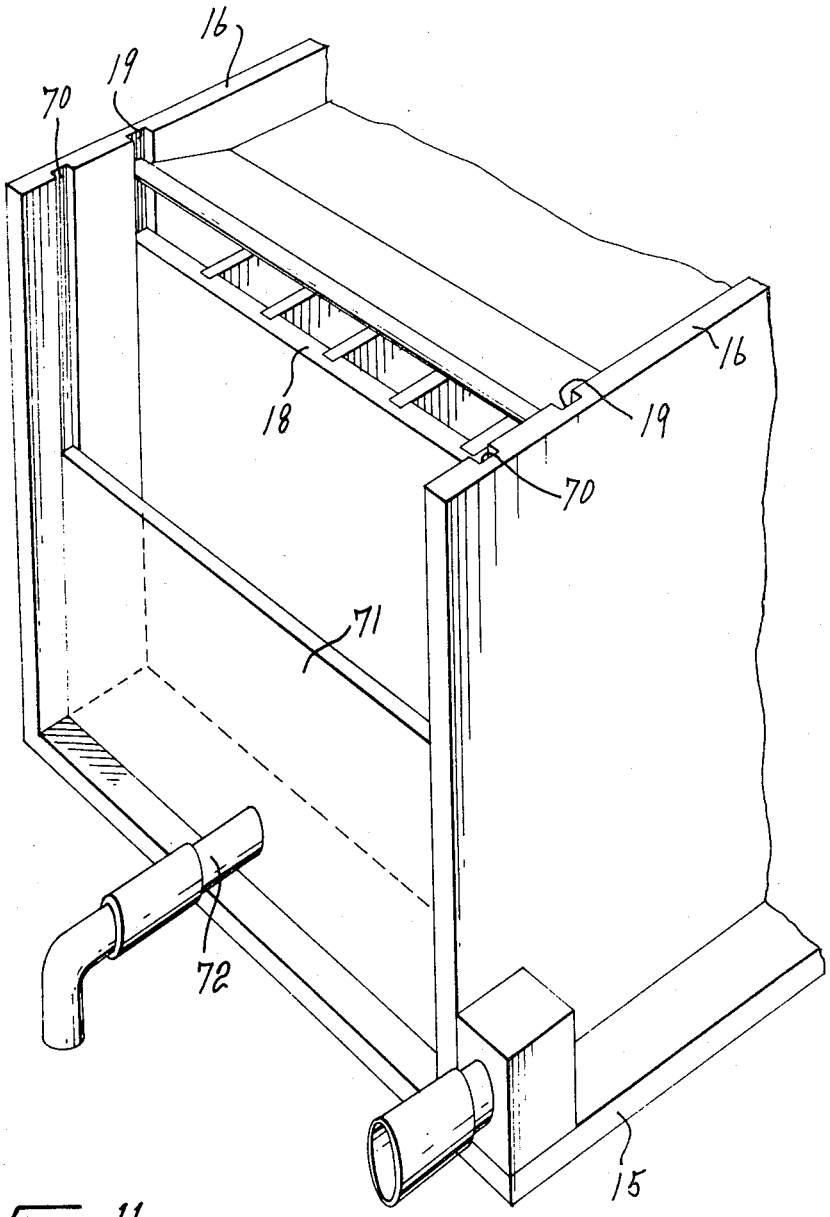
FIG. 11 is a partial perspective view of a print washer similar to that shown in FIG. 1 with a controlled overflow drain.

Another embodiment of the print washer is shown in FIG. 11 wherein a controlled drain is provided. Second vertical grooves 70 are provided outside the vertical grooves 19 in the two rectangular sides 16. A plate 71 fits within the grooves 70 to leave a space between the plate 71 and the weir plate 18. A drain outlet 72 is provided at the base of the plate 71 so that as the water falls over the weir plate 18, it is contained in the space between the weir plate 18 and the plate 71, and then flows out through the drain outlet.

By using the controlled drain shown in FIG. 11 two or more print washers could be used in tandem fed from one water supply, thus saving water. The first print washer is bottom fed and uses an aerator as shown in FIG. 1, the second print washer is mounted at a lower level than the first print washer and is fed from the controlled drain into a top feed box as shown in FIG. 7. Prints are initially placed in the second print washer, and for a final washing step are placed in the first print washer.

In operation, the aerator 35 allows a varied supply of air to be mixed with water passing into a tank for washing prints, negatives and the like. By being able to vary the flow of water and the supply of air, the aerator 35 may be connected to any household water supply. As long as the correct combination of jet size is used in the aerator, air passes into the tank, and the prints float rising up until they are kept beneath the top of the water by the lid. The print paper is not perfectly flat and tends to curve somewhat, but air with the water prevents the paper from sticking to the partition plates. The aerator may be used to drain water from within the tank by means of leaving the collar aperture and the housing aperture coinciding, alternatively, if the two apertures do not coincide, the water remains in the tank. Furthermore, by having a quick connect coupling, the aerator may be used in any one of the system shown herein and is adaptable to other types of tanks not specifically indicated herein As can be seen, the aerator may be fitted to a standard print washer, either having a bottom feed or a top feed, or to a negative washer. Various changes may be made to the tank arrangement, preferably the tank is made from clear acrylic sheet material so that the arrangement of bubbles of air within the tank are seen. However, stainless steel or other material may be used.

The embodiments of the invention in which an exclusive property or privilege is claimed are defined as follows:

1. A washing apparatus for washing photographic materials comprising:

a tank for holding photographic materials, the tank having a generally rectangular shape with a rectangular bottom and rectangular sides, one side having a lower height than the other three sides to form a weir for water overflow, the top of the one side determining the water level in the tank, a raised flow within the tank, a plurality of parallel spaced apart partitions extending across the tank from the raised floor to the height of the one side, a plurality of fluid entrance holes in the raised floor of the tank between the partitions, a cover having a plurality of holes therein extending over the partitions and the one side adapted to allow the water level to rise in the holes above a bottom surface of the cover and keep the photographic materials in the tank below the water level, a fluid distribution system connecting the plurality of fluid entrance holes to an aperture below the raised floor, a removable aerator means removably connected to the aperture of the fluid distribution system where removal of said aerator allows said tank to drain, the aerator means having a connection to a water supply, a replaceable water jet within a tubular housing to allow different sized jets to be used, and an air control means for varying a flow of air into the aerator means downstream of the water jet, to mix with the water from the water jet.

2. The washing apparatus according to claim 1 wherein the plurality of fluid entrance holes in the raised floor between the partitions alternately direct fluid to one or the other of the opposing walls of the spaced partitions between which the fluid entrance holes are located.

3. The washing apparatus according to claim 18 wherein a controlled drain is provided for the water overflow.

4. The washing apparatus according to claim 3 wherein a second washing apparatus is fed from water coming from the controlled drain of a first washing apparatus.

5. A washing apparatus for washing photographic materials comprising:

a tank for holding photographic materials having a cylindrical vertical wall with a circular bottom, a plurality of fluid entrance holes extending out horizontally from a ring at the center of the bottom of the tank, an inverted frusto-conical form located on top of the ring, a fluid distribution system connecting the plurality of fluid entrance holes to an aperture outside and adjacent the bottom of the tank, a removable aerator means adapted to fit into the aperture of the fluid distribution system, the aerator means having a connection to a water supply, a replaceable water jet within a tubular housing to allow different sized jets to be used, and an air control means for varying a flow of air into the aerator means downstream of the water jet to mix with the water from the water jet.

6. A washing apparatus for washing photographic materials comprising:

a tank for holding photographic materials, the tank having a generally rectangular shape with a rectangular bottom and rectangular sides, one side having a lower height than the other three sides to form a weir for water overflow, a raised floor within the tank, a plurality of parallel spaced apart partitions extending across the tank from the raised floor to the height of the one side, a plurality of fluid entrance holes in the raised floor of the tank between the partitions, a fluid distribution system connecting the plurality of fluid entrance holes to an aperture below the raised floor, a pivotable outlet tube removably installed in the aperture to control water level in the tank, a removable rectangular box having a rectangular base with a plurality of perforations therein positioned over the spaced apart partitions and the one side with the perforations located between the partitions, a removable aerator means adapted to fit into one side of the rectangular box, the aerator means having a connection to a water supply, a replaceable water jet within a tubular housing to allow different sized jets to be used, and an air control means for varying a flow of air into the aerator means downstream of the water jet to mix with the water from the water jet.

* * * * *